US007264027B2

(12) United States Patent
Rosenbaum

(10) Patent No.: US 7,264,027 B2
(45) Date of Patent: Sep. 4, 2007

(54) OIL FILLER CAP WITH INTEGRATED FUNNEL APPARATUS

(75) Inventor: Amir Rosenbaum, Los Altos Hills, CA (US)

(73) Assignee: Spectre Performance, Ontario, CA (US)

( * ) Notice: Subject to any disclaimer, the term of this patent is extended or adjusted under 35 U.S.C. 154(b) by 162 days.

(21) Appl. No.: 11/063,770

(22) Filed: Feb. 23, 2005

(65) Prior Publication Data

US 2006/0185763 A1 Aug. 24, 2006

(51) Int. Cl.
*B65B 1/04* (2006.01)

(52) U.S. Cl. ..... 141/338; 184/1.5

(58) Field of Classification Search ..... 141/331–339; 184/1.5

See application file for complete search history.

(56) References Cited

U.S. PATENT DOCUMENTS 5,472,025 A * 12/1995 Conrad et al. ..... 141/332
D403,642 S * 1/1999 Acord ..... D12/197
6,397,907 B1 * 6/2002 Heintz ..... 141/338
6,568,440 B1 * 5/2003 Engelbrecht ..... 141/338
6,837,283 B1 * 1/2005 Wegner ..... 141/338
6,935,389 B1 * 8/2005 Rinaldi ..... 141/337

* cited by examiner

*Primary Examiner*—Steven O. Douglas
(74) *Attorney, Agent, or Firm*—The Hecker Law Group, PLC

(57) ABSTRACT

An oil filler cap with an integrated oil directing funnel. The cap is configurable to fit many automobile makes and models, and is configured to accept the threaded top end of standard quart containers. The integrated funnel is extendible to a fully open position wherein it facilitates replacement of engine oil in a manner preventing spillage onto the engine block and vicinity. Once the outlet of a standard quart container of engine oil is placed into the collapsible funnel to engage the cap structure, the funnel may then collapse to its resting position while passing engine oil from the standard quart container to the engine block. Drainage holes in the cap recapture oil that seeps through or clings to the integrated funnel.

23 Claims, 11 Drawing Sheets

OIL FILLER CAP WITH INTEGRATED FUNNEL APPARATUS

FIELD OF THE INVENTION

This invention relates to the field of automotive components. More specifically the invention relates to an oil filler cap with integrated funnel.

BACKGROUND

Engine oil is a very necessary element for the proper operation and lubrication of an automobile engine. Thus, each automobile has a means or an access opening through which an operator may replenish the engine oil when it falls below a certain level. The means (or orifice) is referred to herein as the oil filler access or opening.

Most commonly, the oil filler opening is provided directly to an interior portion of the engine, though the opening may also be provided to an oil reservoir or other container/flow path which leads to the engine. When the oil filler opening leads directly to the interior of the engine, the oil filler access or opening is usually located at a top portion of the engine, such as at or near the top of the engine block or an associated component of the engine, such as a valve cover, and a removable cap is used to provide a pressure seal during normal engine operation. The removable cap also prevents oil from splashing all over the engine compartment when the engine is running.

In most cases, the configuration of the removable cap is dependent on the automobile engine manufacturer and design. Thus, there could exist almost as many different oil filler caps as there are different makes of automobile engines.

FIG. 1 is an illustration of an automobile engine with an oil filler access or opening. As illustrated, access hole 101 is the oil filler access or opening for engine oil replenishment. As indicated above, the access or opening may be provided directly in a portion of the engine or an associated reservoir or the like, and in the case of an automobile, is generally located in the engine compartment. FIG. 2 is an illustration of a prior art oil filler cap configuration for the engine compartment. Oil filler cap 200 is generally configured to cover the oil filler access 101 of FIG. 1. Thus, in normal operation, oil filler cap 200 couples snugly with oil filler access 101 as illustrated in FIG. 3.

FIG. 3 is an illustration of the prior art oil filler cap installed in place in the engine compartment for normal operation. As illustrated, the oil filler cap and access is generally at the top of the engine and conveniently placed such that any person capable of operating a vehicle can replenish the engine oil with ease. The cap is normally removable by hand to facilitate oil replenishment.

As indicated, because lubricating oil is such a basic necessity for operation of an automobile engine, it is necessary for operators to be capable of easily checking and replenishing the engine oil. Engine oil may be depleted in various ways, including evaporation and burning along with fuel during engine operation. When engine oil levels are too low, insufficient lubrication of moving parts occurs, which may lead to severe engine damage. Thus, most automobile manufacturers ensure that the oil filler access or opening is conveniently located for ease of determination of engine oil level and replenishment as necessary. The configurations are such that most drivers are capable of checking the engine oil of their automobile and topping off the oil when it falls below a recommended level.

Thus, most manufacturers recommend that drivers check their oil level regularly, such as each time they refuel their vehicle, i.e., at the gas (petrol) station. The procedure usually requires checking the engine oil level with a dipstick and if the level is below the manufacturer's recommended level, removing the oil filler cap and topping off the oil back to the manufacturer's recommended level. And finally, replacing the oil filler cap. Unfortunately, due to absent-mindedness or some distraction (e.g. cell phones), some operators forget to replace the oil filler cap after replenishing the engine oil. Therefore, as they drive away from the gas station, the oil filler cap falls off and is lost.

The operator or owner of the vehicle is then forced to purchase a replacement oil filler cap. These filler caps may be very expensive especially depending on the make and manufacture of the vehicle. For instance, the owner of a Mercedes Benz automobile may pay several times more for an oil filler cap than the owner of a Hyundai automobile.

Another significant problem associated with replenishing engine oil is spillage. Engine oil is commonly changed every 3,000 miles, or two months, requiring the addition of fresh oil, typically five quarts, one at a time. Compared with simply checking the oil level and topping off, replacing the oil with five one-quart containers provides five times the opportunity for spillage if no funnel is used.

Lubricating oil is commonly provided in quart-sized containers having an opening through which the oil may be dispensed. This requires the user to invert the container in order to pour or dispense the oil from the container into the oil filler access opening. In this process, it is very common for oil from the container to spill on the engine block or other components of the engine, such as the exhaust manifold, depending on the design of the engine.

The spilled oil may simply become a magnet for dusts thus resulting in the engine compartment becoming unsightly. The spilled oil may damage sensitive components, such as electronic components. The spilled oil may also create a hazard. For example, oil that spills on the exhaust manifold may burn when the engine compartment heats up thus creating unwanted smoke and odor in the passenger compartment of the vehicle. Therefore, to prevent oil spill, some owners and mechanics use an external funnel to direct oil into the oil filler access opening. The funnel is generally a separate device that is not part of the automobile, and thus is stored externally, e.g., in the garage.

Therefore, a need exists for a more convenient and effective means for replenishing engine oil, including addressing problems such as those described above.

SUMMARY OF THE INVENTION

The present invention is directed to an oil filler access or opening closure member and a means for directing or routing oil into such an opening. In one embodiment, there is provided an oil filler access opening cap apparatus with an integrated, oil-directing funnel.

Thus, one or more embodiments of the present invention provide an inexpensive oil filler replacement cap with an integrated collapsible funnel. The oil filler replacement cap is configurable to fit many automobile makes and models. The integrated collapsible funnel is extendible to a fully open position wherein it is usable as a funnel to facilitate replenishment of engine oil and to prevent spillage onto the engine block and vicinity. In the fully open position, the collapsible funnel is configured to direct oil from a container into the oil filler access or opening. In one embodiment, the inside bottom of the funnel cap is configured to hold an "outlet" of a standard quart container of engine oil. The car owner does not have to hold the quart container and wait for it to drain. He or she can set the quart container into the collapsible funnel such that the container outlet engages the oil filler cap, and then he or she can step away. Once the standard quart container of engine oil is placed on the collapsible funnel in the fully open position, the collapsible funnel may then collapse to its resting position while passing engine oil from the standard quart container to the oil filler access or opening without spillage.

The oil filler replacement cap includes a top cover. In an embodiment, the top cover is common to all automobile models. Some embodiments may be configured such that the top cover may be the only part removed during oil replenishment, though other embodiments may be configured such that other portions of the oil cap may also be removed during oil replenishment. Thus, if the top cover is lost, it can easily be replaced for fractions less than the original oil filler replacement cap from the original equipment manufacturer.

Other embodiments of the present invention may be used for other fluid compartments such as transmission, power steering, etc.

DETAILED DESCRIPTION

The invention discloses an oil filler access opening closure member. The invention also discloses means for directing or routing oil to an oil filler access or opening. In the following description, numerous specific details are set forth to provide a more thorough description of embodiments of the invention. It will be apparent, however, to one skilled in the art that the invention may be practiced without these specific details. In other instances, well known features have not been described in detail so as not to obscure the invention.

Figure 4:
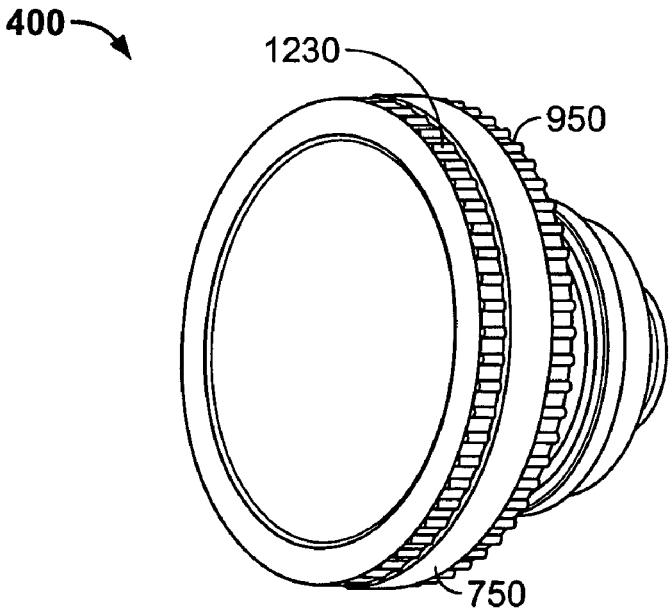
FIG. 4 is an illustration of an oil filler replacement cap in accordance with an embodiment of the present invention.
Figure 5:
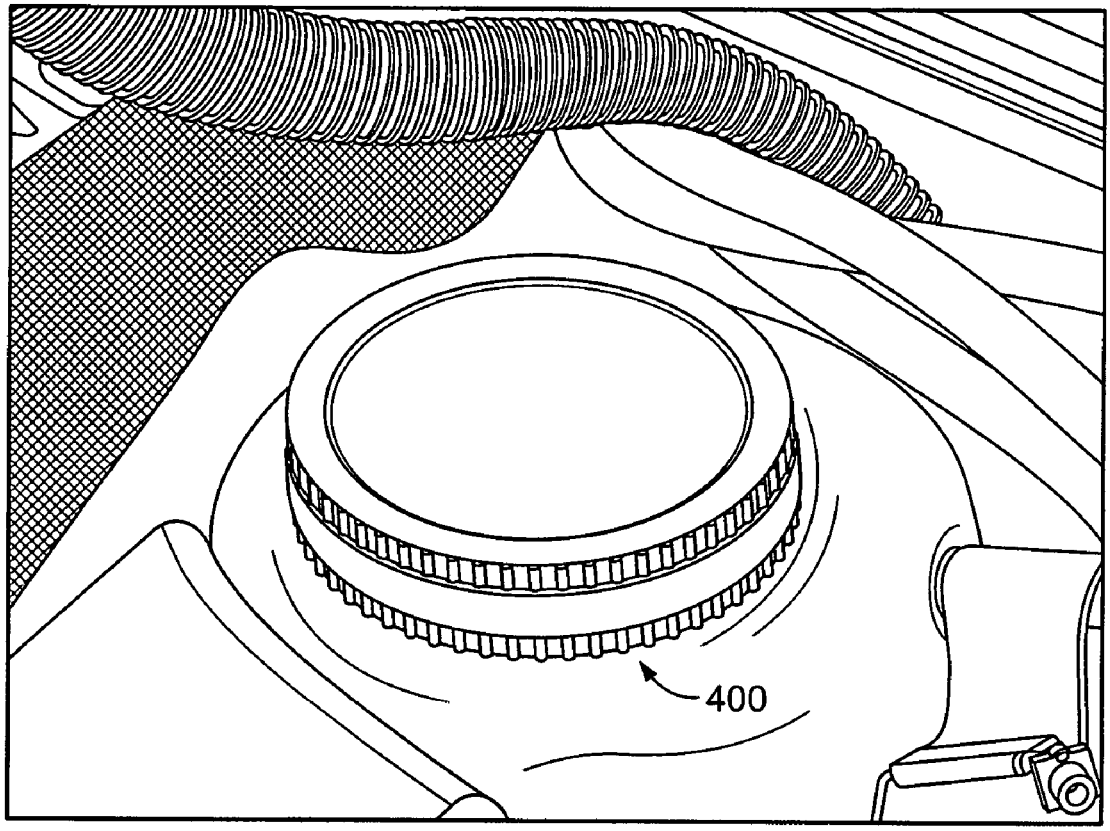
FIG. 5 is an illustration of the oil filler cap of the present invention installed in place in an oil filler access opening for normal operation.

In one embodiment, the present invention comprises an oil filler access or opening closure member. In one embodiment, the closure member is a replacement cap configurable to fit several automobile makes and models. An embodiment of the oil filler replacement cap is illustrated in FIG. 4. Oil filler replacement cap 400 fits snugly into orifice 101 in a similar manner as oil filler cap 200. This is illustrated in FIG. 5. As illustrated, the oil filler replacement cap of the present invention takes the place of the standard oil filler cap provided originally with the automobile. In a preferred embodiment, the oil filler cap or closure member includes an integral means for directing or routing oil to the oil filler access or opening. Due to this added functionality, which is not present in the standard automobile oil filler cap, it may be advantageous to simply replace the standard oil filler cap with the present invention without waiting to lose the original device.

As indicated, one embodiment of the invention is a means for routing or directing engine oil to an oil filler access or opening. In one embodiment of the invention, this means is provided in combination with an oil filler access or opening closure member or cap, such as described above. One embodiment of the invention is thus an oil access or opening filler cap with integrated funnel. An embodiment of the filler cap with integrated funnel of the present invention will now be described in detail with respect to an automobile engine.

It is noted that the embodiments of the invention have utility with other than automobile engines and for directing other than engine oil. For example, the filler cap and integrated funnel may be utilized to close the oil filler access or opening of engines other than those used to power automobiles, such as those used to power trucks, trains, planes and the like. The filler cap and integrated funnel may also be used in other environments where a fluid access opening is provided. These environments include, but are not limited to, equipment such as engines and pumps including access openings for fluids such as transmission oil, hydraulic oil, brake fluid and coolant, among others.

I. Embodiment of General Cap Assembly

Figure 1:
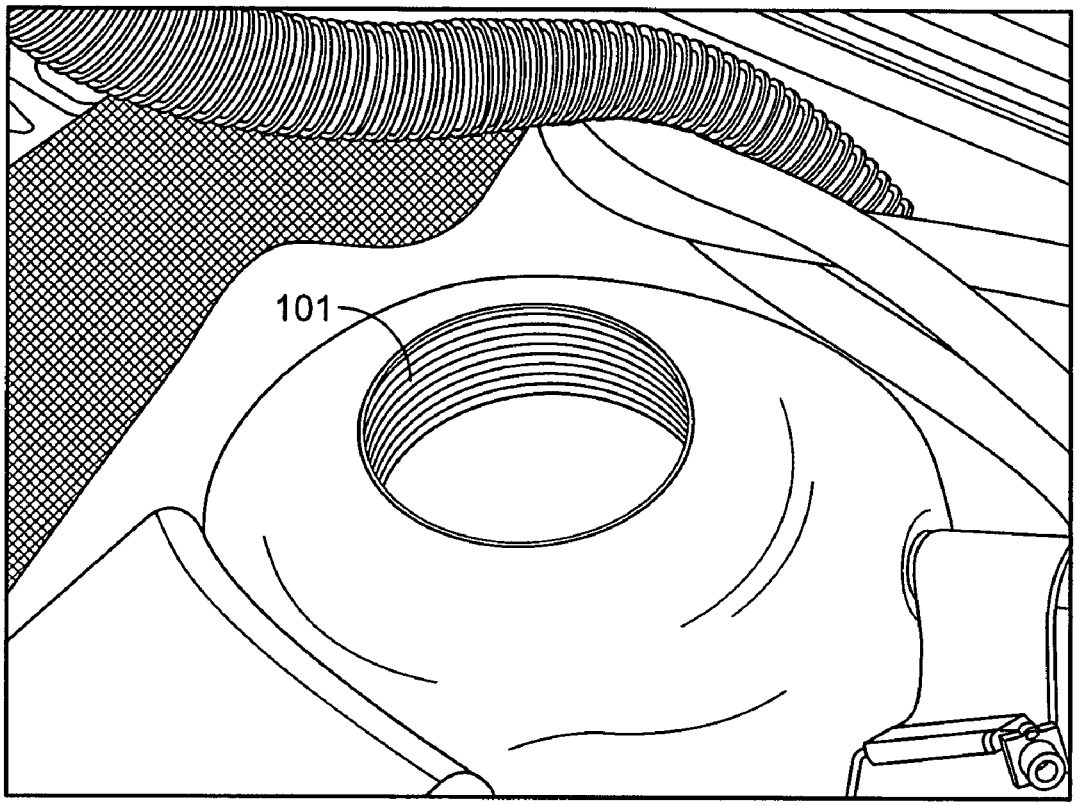
FIG. 1 is an illustration of an automobile engine with an oil filler access opening.
Figure 2:
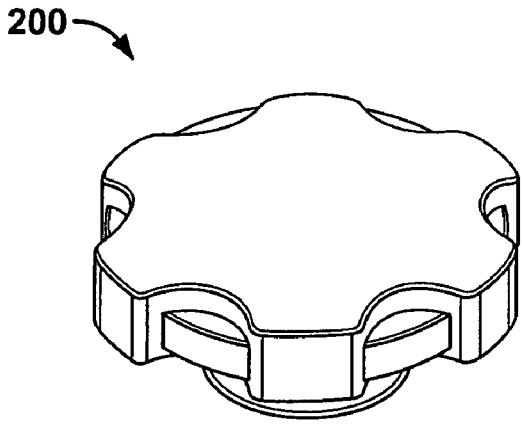
FIG. 2 is an illustration of a prior art oil filler cap configuration for the oil filler access opening.
Figure 3:
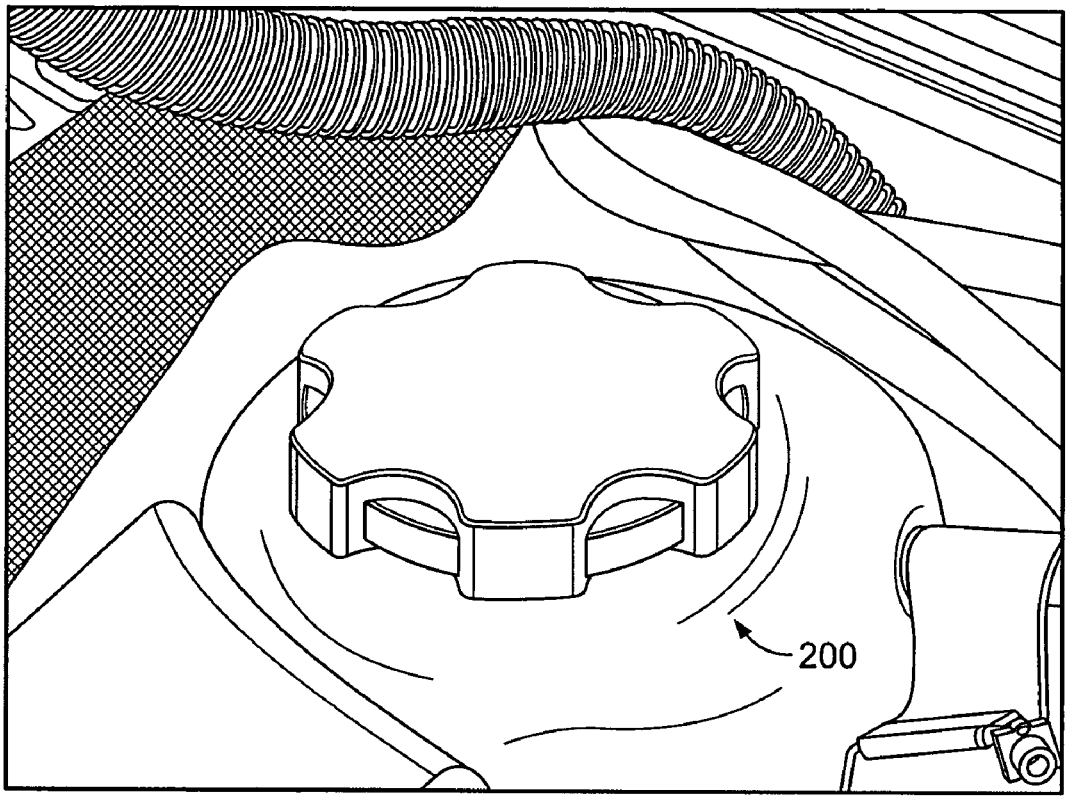
FIG. 3 is an illustration of the prior art oil filler cap installed in place in the oil filler access opening for normal operation.
Figure 6A:
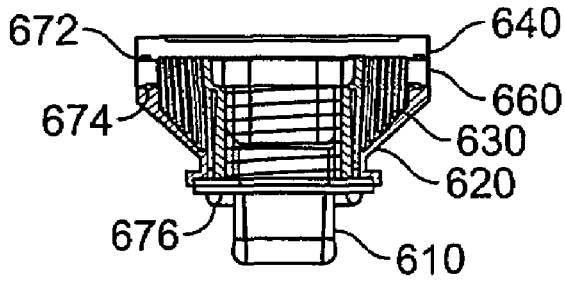
FIG. 6A is an illustration of the oil filler cap assembly of the present invention in a resting/collapsed position.

The oil filler cap assembly of the present invention is illustrated in FIG. 6A in its resting/collapsed position. As illustrated, the oil filler cap assembly comprises a configurable adapter 610; a fixed funnel 620; an integrated collapsible funnel 630; a plurality of sealing members such as gaskets 672, 674, and 676; and a top cover 640. In general, adapter 610 is configured to fit snugly into an oil filler access opening or other opening, such as the orifice 101 of the engine block illustrated in FIG. 1. The fixed and collapsible funnels, 620 and 630, are configured to route fluid, such as engine oil, to the adapter 610. The plurality of gaskets, e.g. 672, 674, and 676, preferably seal various components of the cap and provide a positive pressure lock for the oil filler cap.

In one embodiment, the replacement oil filler cap assembly 400 of the present invention only needs to be installed or connected to an access opening, such as the oil filler access or opening of a vehicle, once. Thereafter, top cover 640 may be the only part removed during oil replenishment, though other embodiments may be configured such that other portions of the oil cap may also be removed during oil replenishment. This provides a significant cost savings advantage over prior art engine oil filler access or opening caps because in most, if not all, embodiments, top cover 640 is the same for all automobiles and thus would be significantly cheaper to replace, if lost, than the original equipment manufacturer oil filler cap. This is because top cover 640 may be manufactured for literally pennies, for instance, and is universal in construction and not specific to a particular manufacturer's engine design.

Figure 6B:
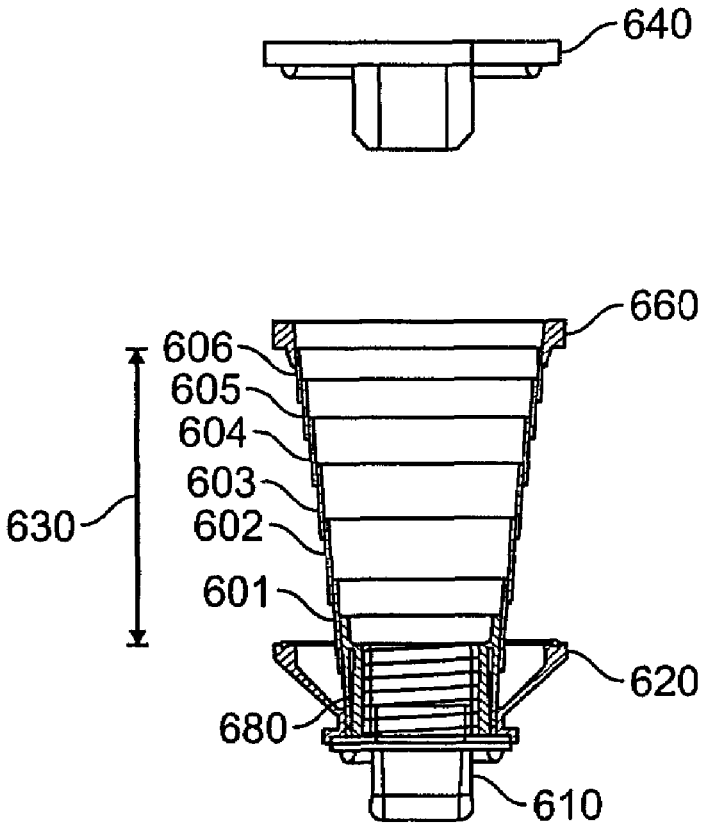
FIG. 6B is an illustration of the oil filler cap assembly of the present invention in an open/extended position.

In one embodiment, the collapsible funnel portion of the cap assembly 400 comprises a plurality of nesting rings which may be moved between a collapsed condition and an extended condition. FIG. 6B is an illustration of the oil filler cap in the open and extended position. As illustrated, collapsible funnel 630 is extended to its full operating position in this configuration. The full extension is accomplished by uncoupling top cover 640 from fixed funnel member 620 and pulling upwards on outer ring member 660 until collapsible funnel 630 locks in full open position, as illustrated.

In this embodiment, the collapsible funnel 630 comprises an outer ring member 660 and a plurality of circular ring members 601 through 606. The outer ring member is illustrated in FIGS. 7A and 7B.

II. Embodiment of Collapsible Funnel Assembly

Figure 7A:
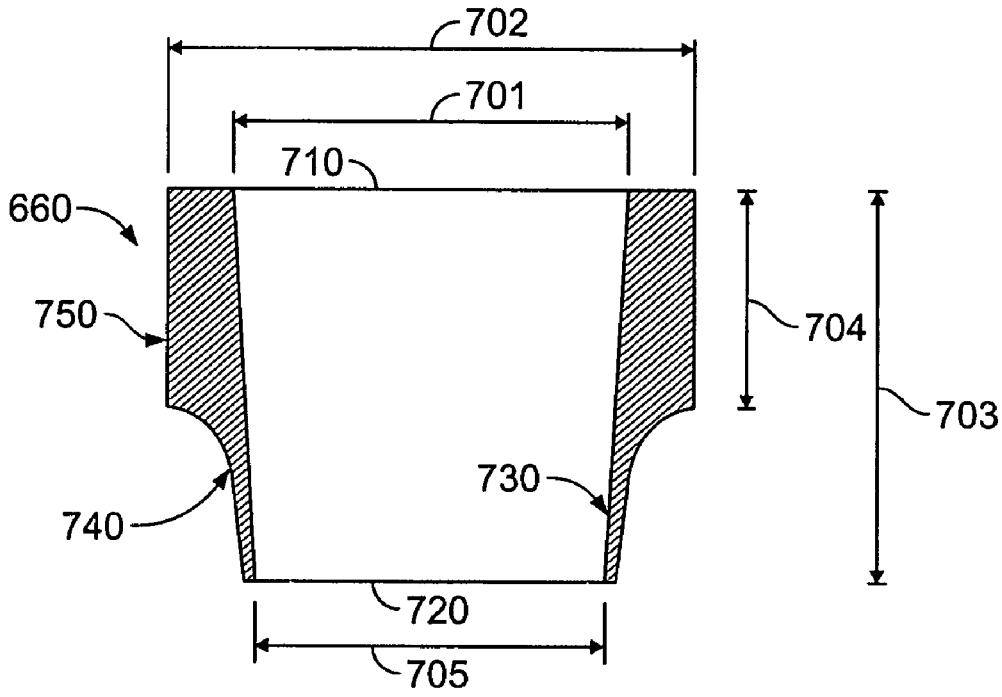
FIG. 7A is an illustration of the side view of the outer ring member 660 in accordance with an embodiment of the present invention.
Figure 7B:
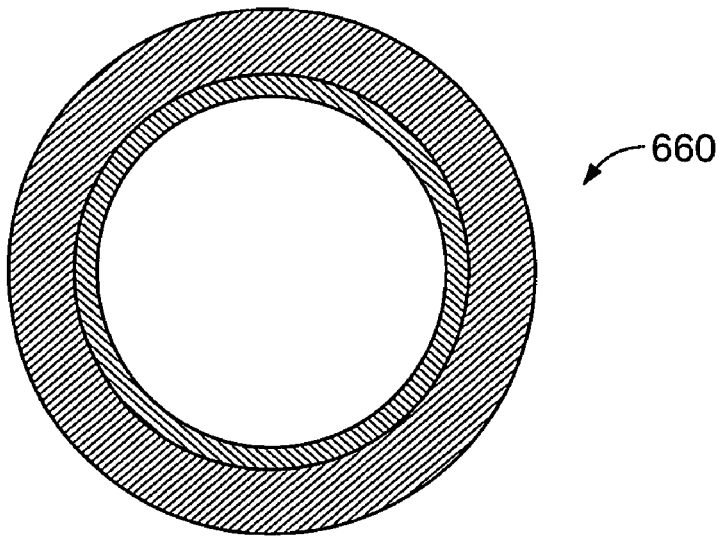
FIG. 7B is an illustration of the top view of the outer ring member 660 in accordance with an embodiment of the present invention.

FIG. 7A is an illustration of the side view of the outer ring member 660 and FIG. 7B is an illustration of the top view of the same outer ring member 660. As illustrated, the outer ring member 660 comprises an upper section 750 and a lower section 740. The outside surface of lower section 740 is configured to sit on top of fixed funnel 620 such that it provides a positive seal, with the aid of a gasket if necessary, with fixed funnel 620 when the oil filler cap assembly is in the closed/resting position.

Thus, in one or more embodiments, the outside surface of the lower section 740 starts linearly at the bottom face 720, becomes curvilinear towards the top of the section (i.e. 740), and then joins the outer surface of top section 750. Top section 750 may have a fixed outside diameter throughout its entire length 704. The outside surface of top section 750 may be smooth to differentiate it and provide tactile feel that is different from that of the top cover 640 and fixed funnel 620.

The diameter of inner surface 730 of outer ring 660 may increase from the fixed dimension 705 at the bottom portion 720 to a fixed dimension 701 at the top portion 710. The change in dimension from bottom to top may be linear or curvilinear, as desired. Thus, in one or more embodiments, the dimension 701 is greater than the dimension 705.

The total height of outer ring 660 is represented by dimension 703. The height of section 740 may be limited by the available storage space within fixed funnel 620, i.e., between the inner side wall of the cone of the fixed funnel and the top of the fixed funnel.

Sample dimensions for an embodiment of outer ring 660 of the present invention are provided in the table below. The outer ring member 660 may be movably coupled to a plurality of circular ring members which is illustrated in FIG. 8.

Figure 8A:
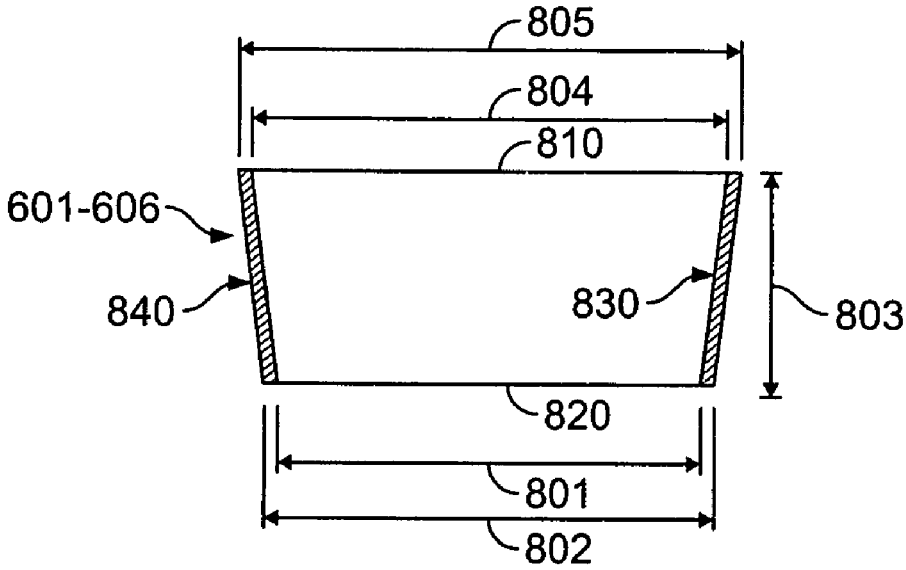
FIGS. 8A and 8C are illustrations of the side cross-sectional views of a circular ring member in accordance with embodiments of the present invention.
Figure 8B:
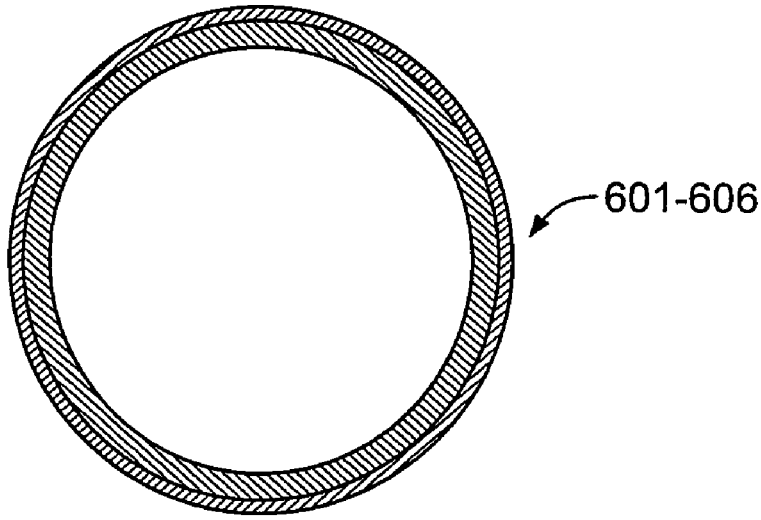
FIG. 8B is an illustration of the top view of circular ring member of FIG. 8A.

FIG. 8A is an illustration of the side view of a circular ring member and FIG. 8B is an illustration of the top view of the same circular ring member. As illustrated, each circular ring member comprises a top portion 810, a bottom portion 820, inner surface 830, and an outer surface 840. The plurality of rings of collapsible funnel 630 are configured such that the diameter of the inner surface 830 of bottom portion 820 (i.e. dimension 801) of a ring member directly above (e.g. top ring member 606) another ring member (e.g. lower ring member 605) is slightly less than the diameter of the outer surface 840 of top portion 810 (i.e. dimension 805) of the lower ring member.

This is further illustrated in the table below. For instance, in the configuration of FIG. 6, circular ring member 602 is directly above circular ring member 601. Thus, the inner top diameter of ring 602 (i.e. 1.820 inches) is less than the outer top diameter of ring 601 (i.e. 1.844 inches).

For each circular ring member, the distance between the top portion 810 and the bottom portion 820 of each ring member is the height 803 of the circular ring member. The height of each ring member is dependent on its relative location in the collapsible funnel, on the angle of the inner surface of the fixed funnel section 940 (see FIG. 9) and the height of section 704 of outer ring member 660.

The diameter of the top and bottom portions of each ring member also depends on its relative position in the collapsible funnel and the desired cone size of the collapsible funnel. For instance, the inner diameter of the top portion 804 may be greater than the inner diameter of the bottom portion 801 if the rings are to snap in place when extended. Also, the outer diameter of the top portion 805 may be greater than the outer diameter of the lower portion 802 to create a funnel effect. Thus the diameter of each circular ring increases from the bottom portion to the top portion. The change in diameter from the bottom portion 820 to the top portion 810 could be linear or curvilinear, for instance, depending on the desired look of the collapsible funnel.

The collapsible funnel may be created by assembling the circular ring members 601 through 606 with the outer ring member 660. The assembly process may comprise the process of dropping the largest circular ring member, e.g. 606, into the outer ring member 660 to create a partial assembly. Circular ring member 606 will not fall through since the outer diameter of its top portion 805 is greater than the inner diameter of the lower portion 705 of outer ring member 660.

The assembly process continues with the next largest circular ring member, e.g. 605, of the remaining circular ring members being dropped into the partial assembly. Followed by the next largest, and so on, until all the circular ring members are in place in the collapsible funnel.

Thus, configuring inner diameter 801 of the bottom portion of an upper ring member (e.g. 606) to be slightly less than outer diameter 805 of the top portion of a lower ring member (e.g. 605) assures that all the rings of the collapsible funnel lock in place at full extension thus creating a funnel. An example configuration of the dimensions in inches of the circular ring members is presented in the table below.

| Circular Ring No. | Inner Bottom Diameter 7/801 | Outer Top Diameter 7/802 | Ring Height 7/803 |
|---|---|---|---|
| 601 | 1.644 | 1.844 | 0.959 |
| 602 | 1.820 | 2.013 | 0.880 |
| 603 | 1.989 | 2.172 | 0.794 |
| 604 | 2.148 | 2.323 | 0.712 |
| 605 | 2.299 | 2.466 | 0.635 |
| 606 | 2.442 | 2.601 | 0.562 |
| 660 | 2.580 | 3.100 | 0.476 |

In the above table illustration, the difference between the outer top diameter of a lower ring member and the inner bottom diameter of a directly adjacent upper ring member is fixed at 0.024 inches. For example, the pair of rings 601 and 602 have a fixed difference of 0.024 (i.e., 1.844-1.820) inches; pair of rings 602 and 603 also have a fixed difference of 0.024 (i.e., 2.013-1.989) inches; and so on. Note that this fixed difference is for illustrative purposes only and does not in any way limit the scope of the invention or signify that such fixed value is used for all embodiments of the present invention. Thus, those of skill in the art would appreciate that the difference between the outer top diameter of a lower ring member and the inner bottom diameter of an upper ring member of adjacent ring pairs may vary for each ring pair of the plurality of rings in the collapsible funnel.

Figure 8C:
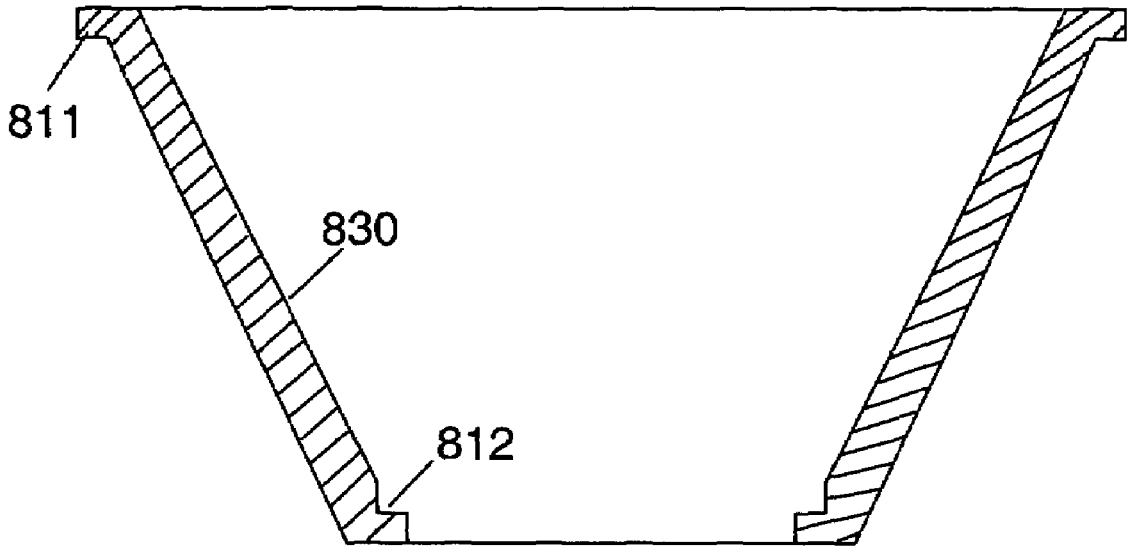
Figure 8D:
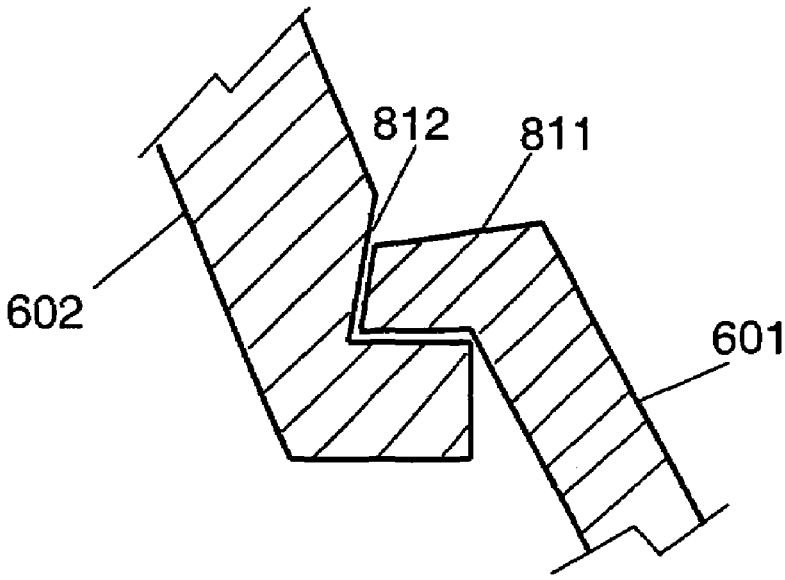
FIG. 8D is a cross-sectional view of interlocking lip and groove structures on funnel rings, in accordance with one or more embodiments of the invention.

As illustrated in FIGS. 8C and 8D, in one or more embodiments, funnel rings 601-606 may each be configured with an outward projecting lip 811 on the upper rim of the funnel ring structure. The inside surface 830 of each of funnel rings 601-606 may be configured with an annular groove 812 in the vicinity of the bottom rim. The actual distance from the groove to the bottom rim may vary for different embodiments, based on such concerns as stability versus absolute extension. Lip 811 is configured to engage groove 812 of the nearest outer neighbor among funnel rings 601-606.

The inner fixed ring 680 may also be configured with a lip 811 on its upper rim to engage a corresponding groove 812 in the innermost collapsible funnel ring (e.g., 601). Similarly, outermost ring 660 may include an annular groove 812 to receive the lip 811 of funnel ring 606.

The lip and groove combination provides a tactile mechanism for interlocking the individual funnel rings together in the extended position, as shown in FIG. 8D. That is, when a person pulls the funnel cap outward, each joint between neighboring rings will snap into place at the desired maximum extension position. Overextension of the funnel is prevented by the interlocking mechanism (assuming the application of normal force), and a secure fit between funnel elements is announced by the tactile (and, in some embodiments, audible) "snap" feedback. With all funnel elements interlocked, the extended funnel provides a stable, supportive pouring aid. When the funnel is no longer needed, a person may push downward on the funnel to disengage the respective lip/groove connections and collapse the funnel into the body of the cap.

In one alternate embodiment, the lip is formed on the inside of the lower rim of each funnel ring, and is configured to engage an annular groove near the top of the outer surface of the nearest inner neighboring ring. In another alternate embodiment, the funnel rings may be configured with outward projecting upper lips and inward projecting lower lips configured to engage each other at full extension. In yet another embodiment, the annular groove may be replaced with an annular ridge on the surface of the ring. The decreasing inner diameter of the outer ring (or a second annular ridge) prevent overextension, whereas the compression fit of the lip over the annular ridge resists collapse of the funnel structure. An annular ridge (or multiple protrusions arranged in a ring) may, in some embodiments, be used as a substitute for the lip structure 811.

Referring back to FIG. 6, the collapsible funnel 630 is coupled to fixed funnel 620 via an inner ring member 680. The fixed funnel is further illustrated in FIGS. 9A through 9C.

III. Embodiment of Fixed Funnel Assembly

Figure 9A:
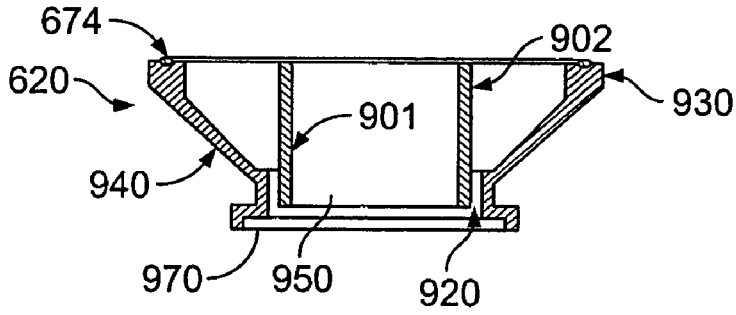
FIG. 9A is a side cutout view of an embodiment of the fixed funnel assembly 620 of the present invention.
Figure 9B:
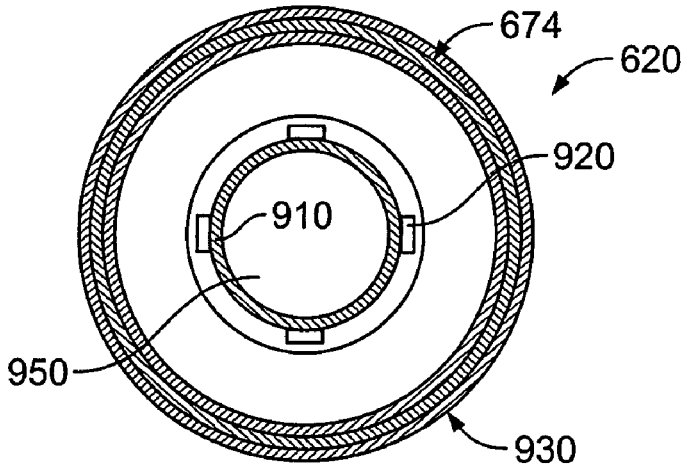
FIG. 9B is a top view of the fixed funnel assembly of FIG. 9A.

As illustrated, FIG. 9A is a side cutout view of an embodiment of the fixed funnel assembly 620 of the present invention; FIG. 9B is a top view of the fixed funnel assembly; and FIG. 9C is an exploded view of side wall 930 showing details of a Finger-Grip configuration in accordance with an embodiment of the present invention.

The fixed funnel assembly 620 illustrated herein comprises mounting column 910 with inner surface 901 and outer surface 902; at least one drainage hole 920; side wall 940; grip surface 930; and gasket 674.

Figure 9C:
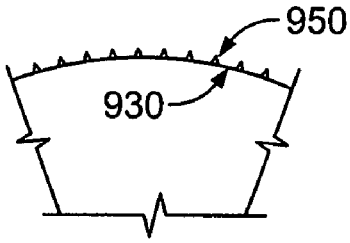
FIG. 9C is an exploded view of side wall 930 of the fixed funnel assembly of FIG. 9A showing details of a Finger-Grip configuration.

As illustrated in FIG. 9C, Grip surface 930 may be configured to provide adequate finger grip to facilitate installation of the oil filler cap assembly of the present invention in place of the original equipment manufacturer's oil filler cap on an automobile engine block. Preferably, such a feature comprises one or more elements or characteristics for increasing the force which may be applied to the cap, such as by increasing the coefficient of friction between the cap and a hand or tool. For instance, surface 930 may include vertical serrations as illustrated in FIG. 9C, or other type of grip pattern. For example, the grip pattern may be angled, crisscrossed, etc. Although it is desirable that grip surface 930 is configured to provide adequate finger grip, other embodiments of the grip surface may be configured for installation using specific or specialized tools.

Mounting column 910 may be configured as a cylindrical member having an inside surface 901 and an outside surface 902. An embodiment of inside surface 901 may be configured with threads for locking top cover 640 in place. Outside surface 902 may be configured to provide snap-fit lock with inner ring member 680, when installed.

The one or more drainage holes 920 between side wall 940 and mounting column 910 provide means for oil leaking through the side walls of the collapsible funnel to drain through to the engine. Thus, the drainage holes 920 are configured with one or more tunnels feeding back into oil fill opening hole 950.

Fixed funnel 620 may be coupled with collapsible funnel 630 via inner ring member 680. FIG. 10 is an illustration of inner ring member 680 in accordance with an embodiment of the present invention.

Figure 10A:
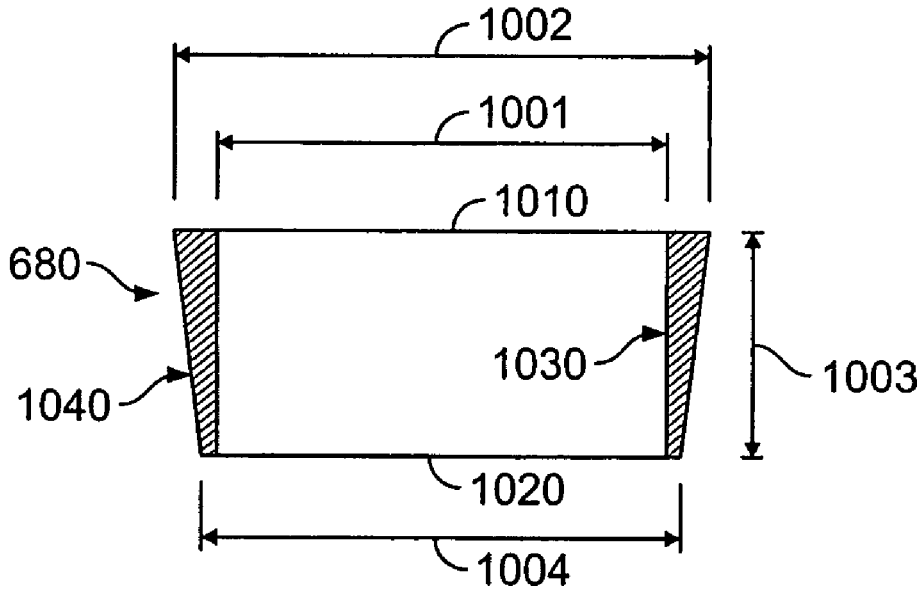
FIG. 10A is an illustration of the side view of inner ring member 680 in accordance with an embodiment of the present invention.
Figure 10B:
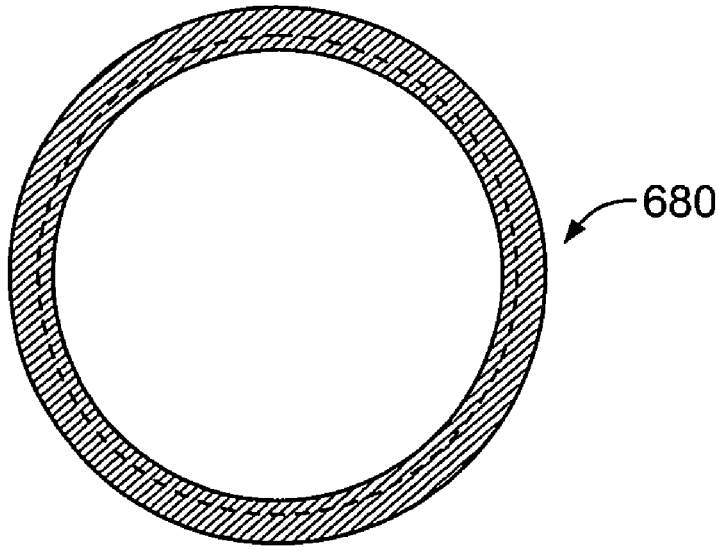
FIG. 10B is an illustration of the top view of inner ring member 680 of FIG. 10A.

FIG. 10A is an illustration of the side view of inner ring member 680 and FIG. 10B is an illustration of the top view of inner ring member 680. As illustrated, inner ring member 680 comprises a top portion 1010, a bottom portion 1020, inner surface 1030, and an outer surface 1040. The inner ring member 680 may be configured such that the diameter 1001 of the inner surface 1030 provides a snap fit with the outside surface 902 of mounting column 910 of the fixed funnel 620. Thus, both surfaces (i.e. 1030 and 902) are configured for easy coupling with one another. For example, inner surface 1030 may be threaded if outside surface 902 of fixed funnel 620 is similarly threaded such that mounting bracket 910 is the male and inner ring member 680 is the female.

The outside diameter of side wall 1040 may be configured to provide fit with the lowest circular ring member (e.g. 601) of the collapsible funnel assembly 630. For instance, the outside diameter of the inner ring member may be variable, e.g., increasing from a lower value to the bottom section 1020 to a larger value to the top section 1010. Thus, the configuration of the outer surface of wall 1040 may be similar to that of the circular ring member described in FIG. 8. That is, inner ring member 680 may be configured such that the diameter of the outer surface 1040 of top portion 1010 (i.e. dimension 1002) is slightly larger than the inner diameter 801 of bottom portion 820 of circular ring member 601, which sits directly above the inner ring member.

The fixed funnel and collapsible funnel may be assembled together by a simple process of dropping the inner ring member 680 into the lowest circular ring member (e.g. 601) of the collapsible funnel assembly. Inner ring member 680 will not fall through since the outer diameter of its top portion 1002 is greater than the inner diameter of the lower portion 801 of lower ring member 601.

Subsequently, the inner ring member and collapsible funnel assembly may be coupled to fixed funnel 620 via mounting column 910.

Inner ring member 680 may be mounted over the outer surface 902 of mounting column 910 and the two members (inner ring 680 and mounting column 910) may be fixably coupled together using a process such as sonic welding, glue, etc. Of course, the selected coupling method may depend on the type of material(s) used for the oil filler cap of the present invention. For instance, example materials may include suitable type of GF (Glass Filled) Nylon, carbon, fiber glass, combinations of metallic and non-metallic materials, etc. In any case, it may be desirable that the heat conduction characteristics of the material used be minimal for several reasons, e.g., to allow ease of removal of top cover 640 after the engine becomes hot, to minimize expansion of the oil filler cap under temperature, etc.

IV. Embodiment of Cap Adapter Assembler

Figure 11A:
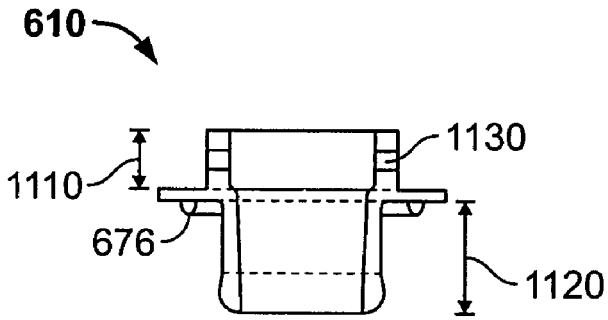
FIG. 11A is a side cutout illustration of a molded bulb adapter configuration in accordance with an embodiment of the present invention.
Figure 11B:
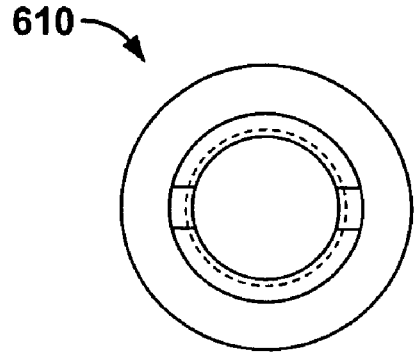
FIG. 11B is a top view of the molded bulb adapter of FIG. 11A.

On the bottom side 970 of the fixed funnel assembly is coupled a suitable adapter 610. The available embodiments of adapter 610 may be as many as there are automobile filler cap configurations in production. The adapter essentially fits in the same oil filler access opening 101 and provides the same positive pressure lock as the original oil filler cap from the vehicle manufacturer. For instance, the adapter may be a cam type, a thread type, etc. A typical adapter configuration is the molded bulb configuration illustrated in FIG. 11. The molded bulb preferably has a nominal size which is greater than the size of the access opening. The bulb may be compressible, however, so that at least a portion of the bulb will fit into or through the opening and then provide a biasing force which effectively seals the opening with the bulb. The bulb may be constructed, for example, of a flexible material and include a central opening which permits compression of the body of the bulb inwardly.

As illustrated, the adapter may be configured to plug into the bottom section 970 of fixed funnel 620. Top section 1110 of adapter may be fixably coupled with fixed funnel 620. For instance, section 1110 may be configured to couple with the inner bottom surface 901 of mounting column 910. A suitable means may be used to fixably couple adapter 610 with fixed funnel 620. As discussed above, a suitable coupling means may include sonic welding, glue, or any other appropriate process for the type of material used in the adapter and funnel cap assembly.

Spill tunnel 1130 provides a conduit from drainage holes 920 to oil fill opening hole 950. One or more spill tunnel 1130 may be included in an embodiment. Also, bottom section 1120 of adapter 610 provides a tight fit with the oil filler access hole 101 of the automobile engine block. A gasket 676 may be included in one or more embodiments to provide positive pressure lock between the engine block and the oil filler cap adapter assembly.

V. Embodiment of Top Cover

Figure 12A:
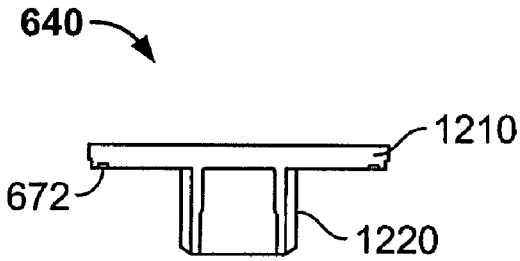
FIG. 12A is a side cutout view of an embodiment of top cover 640 of the present invention.
Figure 12B:
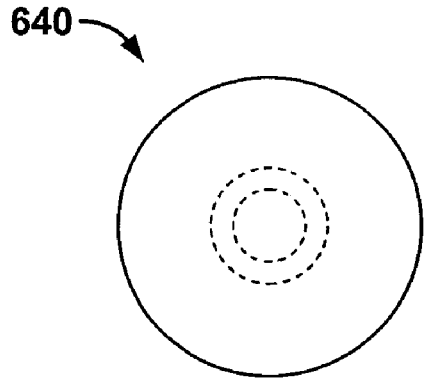
FIG. 12B is a top view of the top cover assembly of FIG. 12A.
Figure 12C:
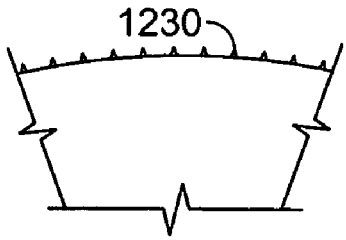
FIG. 12C is an exploded view of the side surface of the top section of the top cover of FIG. 12A showing details of a Finger-Grip configuration.

Another section of the oil filler cap assembly of the present invention is top cover 640 illustrated in FIGS. 12A-12C. As illustrated, FIG. 12A is a side cutout view of an embodiment of top cover 640 of the present invention; FIG. 12B is a top view of the top cover assembly; and FIG. 12C is an exploded view of the side surface of the top section of the top cover showing details of a Finger-Grip configuration in accordance with an embodiment of the present invention.

In the illustrated embodiment, top cover 640 comprises top section 1210; gasket 672, and bottom section 1220. Bottom section 1220 may be threaded on its outside to fit into threads on the inner surface 901 of mounting column 910 thus providing an anchor for top cover 640, when in the closed position. Gasket 672 provides positive pressure lock between top cover 640 and outer ring 660.

Top cover 640 may comprise the same material as the rest of the oil filler cap assembly. In addition, top cover may also include a variety of decorative and non-functional ornamentation. For instance, some decorative materials may be added to the top section 1210 for aesthetic reasons.

The side wall of top section 1210 of top cover 640 may be configured to provide suitable finger grip around its periphery, as illustrated in FIG. 12C. The grip surface may be configured to provide adequate finger grip to facilitate quick installation and removal of the top cover assembly 640 of the present invention. For instance, grip surface 1230 may include vertical serrations as illustrated in FIG. 12C, or other type patterns. For example, the grip pattern may be angled, crisscrossed, etc. Also, although it is desirable that grip surface 1230 is configured to provide adequate finger grip for easy and quick access to the oil filler opening, other embodiments of the grip surface 1230 may be configured for use with specific or specialized tools.

VI. Fluid Flow Illustrations

Figures 13A, 13B, 13C:
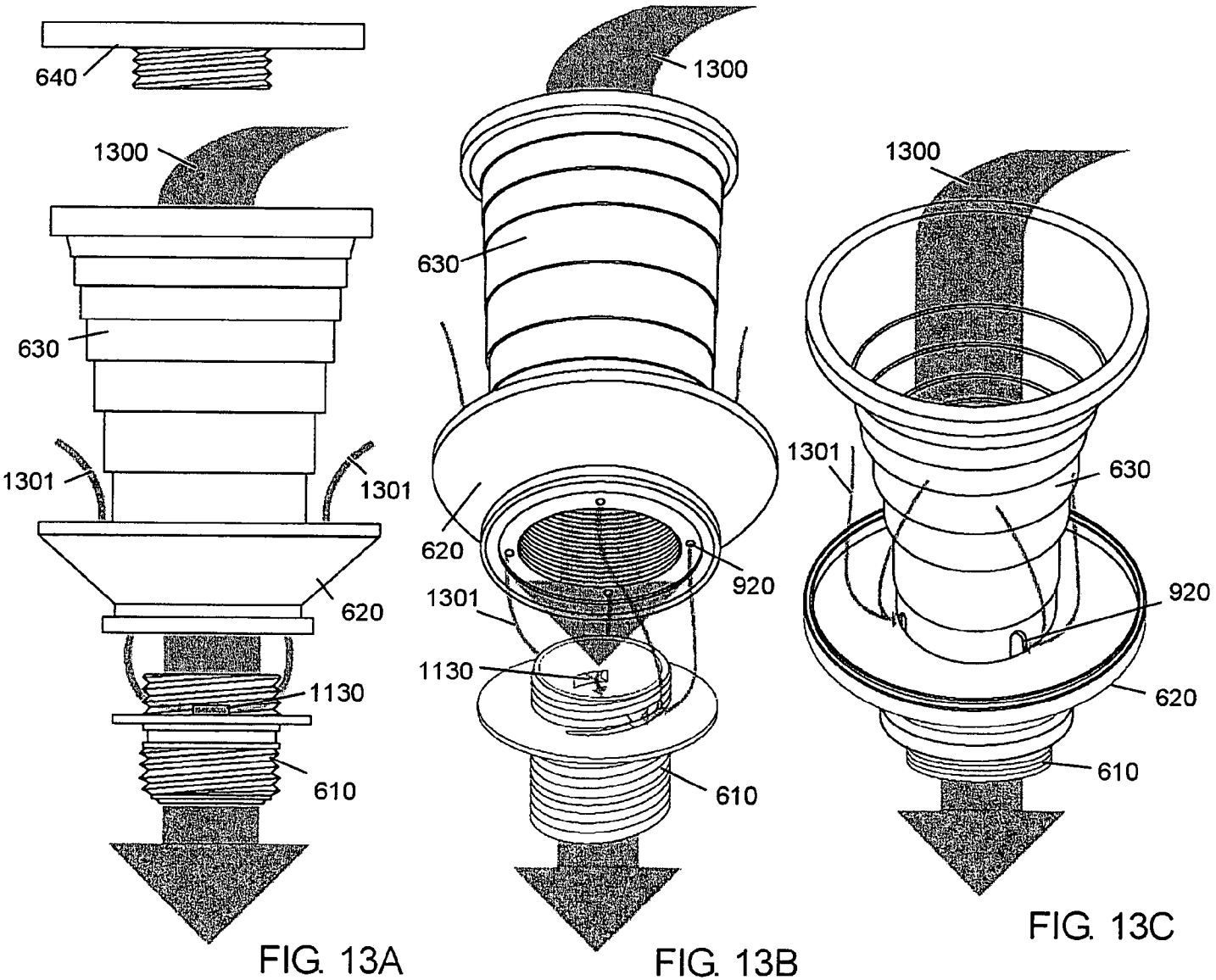
FIGS. 13A-13C are diagrams showing the main flow path and residual flow paths through a fluid filler cap assembly in accordance with one or more embodiments of the invention.

FIGS. 13A-13C illustrate how fluid (e.g., oil) flows through the filler cap assembly in accordance with one or more embodiments of the invention. The large arrow represents the main flow 1300 of fluid through the apparatus, whereas smaller arrows represent the residual flow 1301 of fluid.

FIG. 13A provides a side-view of one embodiment of the invention. In FIGS. 13A and 13B, the fixed funnel assembly 620 is shown detached from the adapter assembly 610 to highlight the flow of fluid through the residual fluid retention apparatus including drainage holes 920 of fixed assembly 620 and spill tunnels 1130 of adapter assembly 610 in one embodiment of the invention.

In FIG. 13B, adapter assembly 610 and fixed funnel assembly 620 are angled to better show the bottom outlets of drain holes 920 in fixed funnel assembly 620 and the spill tunnels 1130 of adapter assembly 610, as well as the main flow 1300 through opening 950. FIG. 13C provides a perspective top view of the apparatus, showing the upper inlets of drainage holes 920 in fixed funnel assembly 620, as well as the origination of residual fluid flows 1301 from the outside surfaces of the collapsible funnel assembly 630.

As illustrated in FIG. 13A, top cover 640 is removed during filling. Collapsible funnel assembly 630 is extended for pouring of fluids, though the collapsible funnel may be permitted to collapse into fixed funnel assembly 620 once the dispensing container outlet has engaged the inner portion 901 of the fixed funnel assembly 620 and adapter assembly 610.

The main flow 1300 of fluid enters the filler cap through the center of collapsible funnel assembly 630, where it is channeled into and through the access core 950 defined by inner surface 901 of fixed funnel assembly 620. Adapter assembly 610 (shown detached in FIGS. 13A and 13B for purposes of illustration, but fitted into fixed funnel assembly 620 during normal use) receives the main flow 1300 from fixed funnel assembly 620, and channels the main flow into the engine block through the engine access opening (not shown) to which the adapter assembly is removably coupled.

Any fluid retained in the collapsible funnel assembly 630 after the funnel elements are collapsed, as well as any fluid spilled onto the outside of the collapsible funnel assembly 630, is captured through the top of funnel assembly 620 as residual flows 1301. The side wall 940 and surface 902 channel the residual flow 1301 through one or more top inlets of drainage holes 920. The residual flow passes from the lower outlets of drainage holes 920 into an annular gap between fixed funnel assembly 620 and adapter assembly 610, from which the residual flow 1301 is channeled back into the main flow 1300 through one or more spill tunnels 1130.

VII. Other Embodiments

Other embodiments of the invention are contemplated. As indicated, in one embodiment, the collapsible funnel comprises one or more rings which move relative to one another between a collapsed and extended condition. The funnel may have other configurations, however. For example, the funnel might comprise a flexible wall member, such as a flexible sheath, which may be compressed to a flat or collapsed state, or stretched or extended to define a flow path for fluid. The funnel may also comprise a single rigid element which may be moved inwardly and outwardly between a collapsed position and an extended position. The funnel may also be defined by a plurality of elements which are movable relative to one another in other than the axial direction. For example, in one embodiment, a plurality of elements may be rotatably nested such that, when twisted one direction, they expand to define an elongate flow path, but when twisted in another, they contract. Such embodiments of the invention may be associated with the fluid access opening in a variety of ways. In one embodiment, those elements are associated with an adaptor and may be closed with a cap, as described above.

The cap may also be constructed in other ways than described. In the preferred embodiment, the collapsible funnel is mounted to a fixed funnel, the fixed funnel acting as a mounting base, container for the collapsible funnel when in its closed position, and serving to collect any oil or other fluid which leaks from the fixed funnel. In other embodiments, the fixed funnel may be eliminated. For example, where an impermeable sheath is used as the collapsible funnel, that sheath might be mounted directed to the adapter. In such event, the adapter might include an upwardly extending wall to which the sheath is mounted and over which the cover may be selectively placed.

Thus, an oil filler access or opening closure member, a fluid directing member and a cap with an integrated funnel, has been described. Particular embodiments described herein are illustrative only and should not limit the present invention thereby. The invention is defined by the claims and their full scope of equivalents.

The invention claimed is:

1. An oil filler cap apparatus comprising:

an adapter module couplable at one end to an automobile engine oil fill access opening;

a fixed funnel module having a top side and a bottom side, wherein said bottom side of said fixed funnel module is coupled to a second end of said adapter module;

a collapsible funnel module coupled to an inside section of said bottom side of said fixed funnel module, wherein said collapsible funnel module comprises a fully extended and a fully retracted configuration, and wherein said collapsible funnel module is fully contained inside said fixed funnel module when in said fully retracted position; and a top cover module removably couplable to said top side of said fixed funnel module.

2. The apparatus of claim 1, wherein said adapter module comprises a bulb type finish at said end couplable to said automobile engine oil fill access opening.

3. The apparatus of claim 1, wherein said adapter module comprises a cam type finish at said end couplable to said automobile engine oil fill access opening.

4. The apparatus of claim 1, wherein said end of said adapter module couplable to said automobile engine is configured to provide a pressure lock-fit with said automobile's oil filler access opening.

5. The apparatus of claim 1, wherein said fixed funnel module comprises:

one or more drainage holes at inside wall of said fixed funnel module near a bottom side to direct spilled fluids from said collapsible funnel module back through said fixed funnel module;

a hollow cylindrical mounting column extending upwards from said bottom side of said fixed funnel module, said hollow cylindrical mounting column having an outside bottom section, an inside bottom section, an outside top section, and an inside top section;

said outside bottom section fixably coupled to said inside wall of said fixed funnel module at said bottom side.

6. The apparatus of claim 5, wherein said second end of said adapter module is coupled to said inside bottom section of said hollow cylindrical mounting column.

7. The apparatus of claim 5, wherein said inner ring of said collapsible funnel module is coupled to said outside top section of said hollow cylindrical mounting column.

8. The apparatus of claim 5, wherein said top cover module couplable to said top side of said fixed funnel module comprises coupling said top cover module to said inside top section of said hollow cylindrical mounting column when said collapsible funnel module is in a collapsed position.

9. The apparatus of claim 1, wherein said collapsible funnel module is expandable to a fully extended position when said top cover module is removed.

10. The apparatus of claim 1, further comprising:

a first gasket at said bottom side of said fixed funnel module to provide pressure lock with said access opening;

a second gasket to provide pressure lock between contacts of an outer ring of said collapsible funnel module and said fixed funnel module; and a third gasket to provide pressure lock between contacts of said outer ring of said collapsible funnel module and said top cover.

11. An apparatus comprising:

an adapter module having a first end and a second end, said first end of said adapter module couplable to an access opening for replacement fluids;

a fixed funnel module having a bottom side and a top side, said fixed funnel module fixably coupled at said bottom side to said second end of said adapter module;

a collapsible funnel module having a plurality of rings, said plurality of rings comprising an inner ring end and an outer ring end, said collapsible funnel module fixably coupled at said inner ring end to inside wall of said bottom side of said fixed funnel module, wherein said collapsible funnel module is fully contained inside said fixed funnel module when in a fully collapsed position; and a top cover module removably couplable over said outer ring end of said collapsible funnel module to said top side of said fixed funnel module.

12. The apparatus of claim 11, wherein said adapter module is a bulb type module at said first end.

13. The apparatus of claim 11, wherein said adapter module is a cam type module at said first end.

14. The apparatus of claim 11, wherein said access opening for replacement fluids is an automobile's oil filler access opening.

15. The apparatus of claim 14, wherein said first end of said adapter module is configured to provide a pressure lock-fit with said automobile's oil filler access opening.

16. The apparatus of claim 11, wherein said fixed funnel module comprises:

one or more drainage holes at inside wall of said fixed funnel module near said bottom side to direct spilled fluids from said collapsible funnel module back through said fixed funnel module;

a hollow cylindrical mounting column extending upwards from said bottom end of said fixed funnel module, said hollow cylindrical mounting column having an outside bottom section, an inside bottom section, an outside top section, and an inside top section;

said outside bottom section fixably coupled to said inside wall of said fixed funnel module at said bottom side.

17. The apparatus of claim 16, wherein said second end of said adapter module is coupled to said inside bottom section of said hollow cylindrical mounting column.

18. The apparatus of claim 16, wherein said inner ring of said collapsible funnel module is coupled to said outside top section of said hollow cylindrical mounting column.

19. The apparatus of claim 16, wherein said top cover module couplable to said top side of said fixed funnel module comprises coupling said top cover module to said inside top section of said hollow cylindrical mounting column when said collapsible funnel module is in a collapsed position.

20. The apparatus of claim 11, wherein said collapsible funnel module is expandable to a fully extended position when said top cover module is removed.

21. The apparatus of claim 11, further comprising:

a first gasket at said bottom side of said fixed funnel module to provide pressure lock with said access opening;

a second gasket to provide pressure lock between contacts of said outer ring of said collapsible funnel module and said fixed funnel module; and a third gasket to provide pressure lock between contacts of said outer ring of said collapsible funnel module and said top cover.

22. The apparatus of claim 11, further comprising means for interlocking said plurality of rings in an extended position.

23. An oil filler cap apparatus comprising:

an adapter module having a first end and a second end, said first end of said adapter module removably couplable to an oil filler access opening of an automobile engine block;

a fixed funnel module having a bottom side and a top side, one or more drainage holes at inside wall of said fixed funnel near said bottom side to direct spilled fluids back through said fixed funnel module, a hollow cylindrical mounting column extending upwards from said bottom end of said fixed funnel module, said hollow cylindrical mounting column having an outside bottom section, an inside bottom section, an outside top section, and an inside top section, said outside bottom section of said hollow cylindrical mounting column fixably coupled to said inside wall of said fixed funnel module at said bottom side and said second end of said adapter module fixably coupled to said inside bottom section of said hollow cylindrical mounting column;

a collapsible funnel module having a plurality of rings, said plurality of rings comprising an inner ring end and an outer ring end, said collapsible funnel module fixably coupled at said inner ring end to said outside top section of said hollow cylindrical mounting column of said fixed funnel module; and a top cover module removably couplable over said outer ring end of said collapsible funnel module to said inside top section of said hollow cylindrical mounting column of said fixed funnel module.

* * * * *